United States Patent [19]

Zapico

[11] Patent Number: 4,729,437

[45] Date of Patent: Mar. 8, 1988

[54] SEDIMENT SAMPLER

[76] Inventor: Michael M. Zapico, #8 Krug Street, Kitchener, Ontario, M2H 2X7, Canada

[21] Appl. No.: 853,886

[22] Filed: Apr. 21, 1986

[51] Int. Cl.[4] ..... E21B 49/02; E21B 25/00

[52] U.S. Cl. ..... 175/20; 175/58

[58] Field of Search ..... 175/20, 19, 21, 22, 175/23, 405, 239, 244, 253, 249

[56] References Cited

U.S. PATENT DOCUMENTS

| | | | |
|---|---|---|---|
| 1,853,581 | 4/1932 | Schmissrauter et al. | 175/58 |
| 3,696,873 | 10/1972 | Anderson | 175/20 |
| 3,817,338 | 6/1974 | Guest | 175/20 X |
| 3,833,075 | 9/1974 | Bachman et al. | 175/20 |
| 3,872,935 | 3/1975 | Mielke | 175/20 X |
| 4,252,200 | 2/1981 | Peterson | 175/20 |

FOREIGN PATENT DOCUMENTS 2923262 12/1980 Fed. Rep. of Germany .

*Primary Examiner*—Stephen J. Novosad

*Attorney, Agent, or Firm*—Anthony Asquith & Co.

[57] ABSTRACT

The sampler disclosed comprises a barrel assembly (21) that is hammered into the ground, from the surface. Hammer-drive-rods are disconnectable from the barrel by manipulation from the surface by means of a left-hand-screw-thread connection (31). The barrel is pulled out of the hole by means of a draw-cable (20). The barrel includes an inner sleeve (16), made of thin aluminum or plastic. This sleeve is cut open to reveal the sample. The sleeve itself is relieved of the hammer blows and other stresses, which are taken entirely by the barrel.

1 Claim, 3 Drawing Figures

SEDIMENT SAMPLER

This invention relates to a device for extracting a sample of sediment from a hole in the ground. The device is particularly, though not exclusively, intended for use for extracting samples to test the samples for the presence of pollutants.

BACKGROUND TO THE INVENTION

When the sediment that is to be sampled is sandy, and saturated with water, the difficulty arises that the sample tends to fall out of the sample-holder as the sample-holder is being transported to the surface. Unless the sediment is quite cohesive—if the sediment is clay-ey, for example—the slightest knock or jar on the sample-holder can cause the sample of sediment to fall out of the holder.

One approach to the problem of gathering and containing a sample of sand, or the like, is as follows. The sample-holder may comprise a tube that is hammered down into the ground, by means of drive-rods from the surface. One way of removing the sample holder from the ground in such a case is to keep the tube attached to the bottom one of the drive rods, and to progressively unscrew the rods from each other as the sample is being brought up. But it is this act of unscrewing the lengths of drive rod from each other that leads to the troublesome jarring that shakes out the sample.

As an alternative, the tube may be provided with a cable: now, the rods are detached from the tube while the tube is still at the bottom of the hole. The rods can be withdrawn and unscrewed, and any jarring in that operation has no effect on the tube or the sample. Later, the tube may be pulled up—smoothly—by means of the cable.

A refinement to this manner of removing the tube, and the sample, from the hole is this. The tube is provided with a piston, which is a sliding fit in the tube. The cable is attached to the piston, not to the tube. The piston is positioned at the foot of the tube, with the tube in position at the bottom of the hole. The cable is now anchored (at the surface). As the tube is hammered down, the piston is prevented from travelling downwards, so that the piston in effect is caused to rise up the tube.

This action tends to make it possible for the sample to enter fully right up into the tube as the tube is hammered downwards. The piston is a very tight fit in the tube, so that the tension in the cable during hammering is considerable. The tightness of the piston is important, because as the tube is being withdrawn up the hole, the weight of the sample is being supported, at least partially, by the frictional grip of the piston to the tube.

It is important also that the piston be perfectly sealed in the tube, since any air leakage around the seal could destroy the suction effect, which again could allow the sample to fall out of the tube The piston, arranged in that manner, has been found to be very effective when retaining saturated sands, and other low-cohesion sediments.

It is recognized in the invention that there is a difficulty remaining with the anchored-piston technique just described, and that is that some sediments, though of low-cohesion, nevertheless require quite vigorous hammering of the tube in order to drive the tube down into the sediment.

This is a problem because the tube has to be relatively thin, and has to be made of soft material. The tube has to be thin and soft because the tube has to be cut open along its length in order to extract the sample from the tube. The invention is aimed at overcoming this difficulty.

GENERAL DESCRIPTION OF THE INVENTION

The basis of the invention lies in the idea of housing the tube within a barrel assembly, and of using the barrel assembly to support the hammer blows. The barrel assembly is dismantleable for the purpose of extracting the tube. The tube comprises, in fact, an inner sleeve that fits inside the barrel assembly, and the inner sleeve is arranged between shoulders to locate the inner sleeve within the barrel assembly.

In the invention, the inner sleeve can therefore be tailored, without compromise, to the requirement of being able to contain the sample, and being able to be easily cut open. Ordinarily, standard, thin-walled aluminum or plastic tubing is quite adequate for the job, and such tubing is readily available in many standard sizes. Since the piston has to slide up the internal bore of the inner sleeve, the bore should be smooth and dimensionally-uniform, but commercially-available tubing is quite adequate from that standpoint too.

In the invention, the inner sleeve is simply a parted-off length of tubing, with no requirement for holes to be drilled, nor for threads to formed, nor for any other machining or finishing operations to be carried out. This simplicity is very important in a component that will be cut up and discarded after a single usage.

DETAILED DESCRIPTION OF A PREFERRED EMBODIMENT OF THE INVENTION

An example of a sediment sampler which embodies the invention will now be described with reference to the accompanying drawings, in which.

Figure 1:
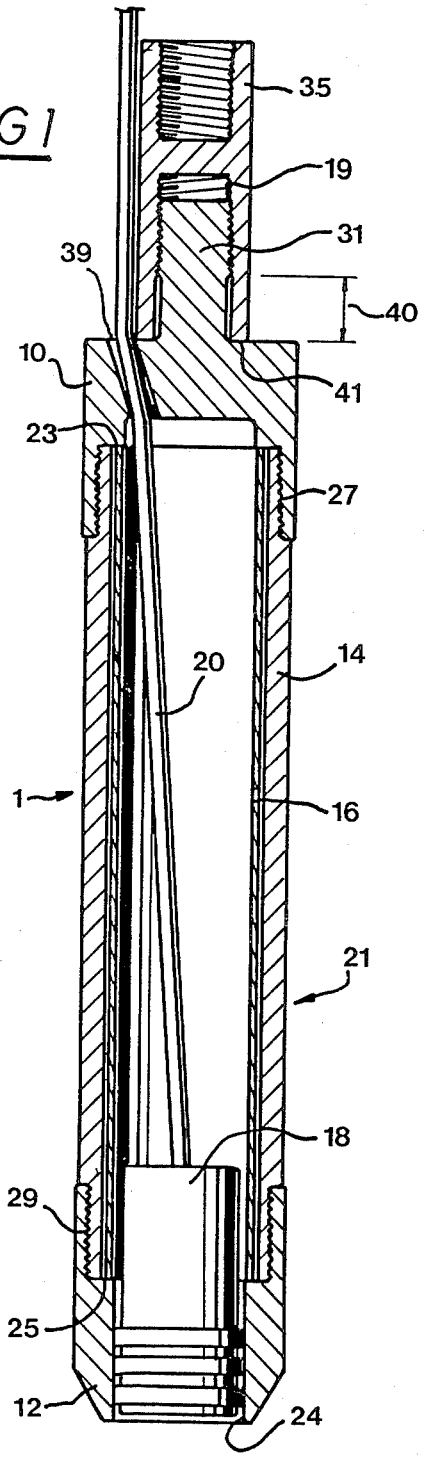
FIG. 1 is a cross-section of the sampler.
Figure 3:
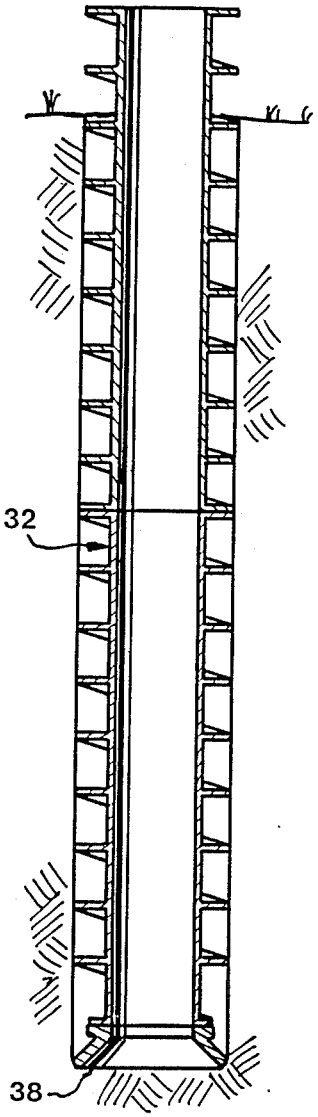
FIG. 3 is a cross-section through a hole in the ground, showing the sampler in use.
Figure 2:
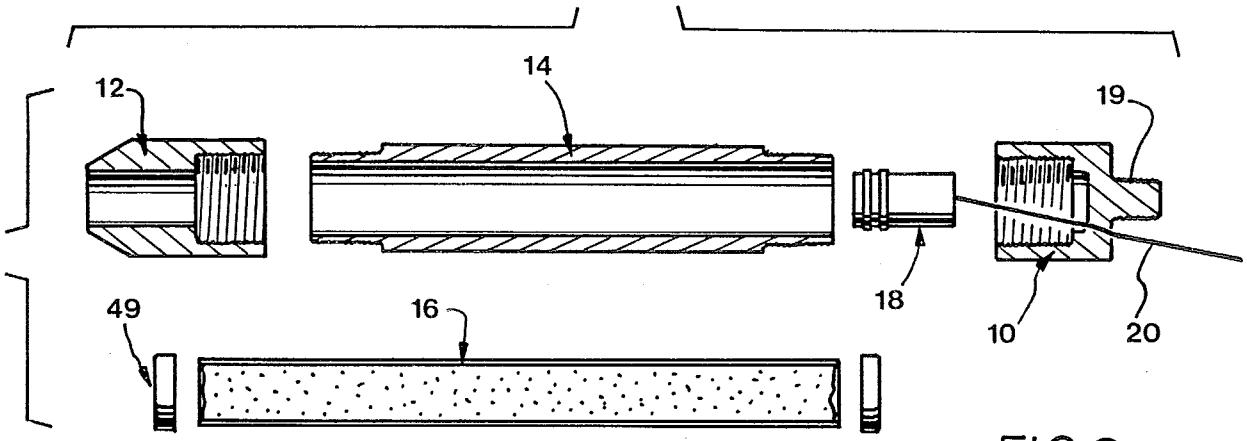
FIG. 2 is an exploded view of the sampler.

The sampler 1 comprises an upper-drive-head 10, a drive-shoe 12, an outer-sleeve 14, an inner-sleeve 16, a piston 18, and a cable 20. The upper-drive-head 10, the drive-shoe 12, and the outer-sleeve 14 together comprise a barrel-assembly 21.

The upper-drive-head 10 is formed with an upper shoulder 23, and the drive-shoe 12 is formed with a lower shoulder 25. There are screw thread connections 27 between the upper-drive-head 10 and the outer-sleeve 14 and 29 between the drive-shoe 12 and the outer-sleeve 14. When the barrel-assembly 21 is assembled, by means of the screw-thread-connections 27,29, the shoulders 23,25 lie facing each other from opposite ends of the barrel-assembly 21.

The inner-sleeve 16 is positioned inside the barrel-assembly 21, and is located axially between the two shoulders 23,25. The length of the inner-sleeve 16 and of the barrel-assembly 21 is such that the inner-sleeve 16 is compressed axially by a small amount. The purpose of this compression is to ensure that none of the materials entering the sampler can pass around the ends of the inner-sleeve 16. If any sediment were to be trapped between the two sleeves, it could become difficult to separate the two sleeves later.

A stalk 31 protrudes from the upper-drive-head 10, and the stalk 31 is provided with a left-hand thread 19.

Next, the sampler 1 is used in the following manner. First, an auger 32 is used to bore a hole in the ground. The auger 32 is left in the hole while the sample is being taken.

The sampler 1 is lowered into the hole, with a hammer-drill-rod attached. (The hammer-drill-rod has a right-hand-thread and is attached to the stalk 31 by means of an adapter 35.) Further rods are added as the sampler is lowered until the sampler 1 reaches the bottom 38 of the hole produced by the auger 32.

Before the sampler 1 is lowered down the hole, the piston 18 is positioned at the bottom of the barrel-assembly 21. The tightness of the fit of the piston 18 in the inner-sleeve 16 is adjustable, in a manner to be described below, and the fit is now adjusted to be very tight.

Next, the sampler is lowered down the hole, the cable being slack during lowering. When the sampler is in position resting at the bottom 38 of the hole, the cable 20 is drawn taut, to ensure that the piston 18 cannot descend below the level of the bottom 38. The cable 20 passes through a hole 39 in the upper-drive-head 10, and the cable 20 can be manipulated from the surface.

Now, the rods are hammered downwards from above. The barrel-assembly 21 travels downwards in reponse to the hammer blows, but the piston 18, because it is tethered by the cable 20, does not travel downwards. As the sampler 1 is hammered into the sediment, a sample of the sediment is driven into the sampler 1, and fills the inner-sleeve 16 as the piston 18 "rises" to the top of the inner-sleeve 16.

The drive-shoe 12 is bored out to the same diameter as the bore of the inner sleeve 16, whereby the piston slides smoothly from one to the other.

When the sample has completely entered the inner-sleeve 16 the sample is retrieved in the following manner. First, the hammer-drill-rod and the rest of the rods are detached from the sampler 1. This is achieved by turning the rods clock-wise, an action that causes the adapter 35 to unscrew from the stalk 31.

The rods may be unscrewed from each other as they are taken out of the hole. Any jarring of the rods during the unscrewing operation of course cannot affect the sediment sample in the sampler, because the sampler remains embedded in the ground at the bottom of the hole while the rods are being withdrawn.

Once the rods are clear, the sampler itself may be withdrawn by pulling the cable 20. The sampler rises smoothly up the hole without vibration under a steady pull, as the cable 20 is winched up.

The sample needs to have only a minimal amount of cohesiveness when the sample is collected in this manner. However, some cohesiveness is needed, in that a very runny sample might fall out of the open bottom of the sampler as the sampler is being withdrawn.

Once the sampler is out of the hole, the sampler is disassembled. First, the upper-drive-head 10 is unscrewed from the outer-sleeve 14. The outer-sleeve 14 and the drive-shoe 12 should not be in any way a tight fit on the inner-sleeve 16, in order to ensure that the outer-sleeve 14 and the drive-shoe 12 can be unscrewed and removed from the upper-drive-head 10 and the inner-sleeve 16 without disturbing the inner-sleeve 16, and without disturbing the sample within the inner-sleeve 16.

When the outer-sleeve 14 and the drive-shoe 12 have been removed, the piston 18 can be pulled out of the inner-sleeve 16, leaving the inner-sleeve 16 completely dis-assembled from the barrel-assembly. The inner-sleeve 16 is of thin aluminum tubing, which is about 1 mm or 1.5 mm thick, so that it is a simple matter to slit the inner-sleeve 16 longitudinally, to examine the sample. The inner-sleeve 16 can alternatively be made of thin plastic, since the inner-sleeve, in the invention, is not required to support any loads or stresses itself.

While examination of the sample is proceeding, the barrel can be re-assembled with a fresh inner-sleeve inside, and made ready for the next sample.

If it is inconvenient to examine the sample there and then, the sample may be protected with caps 49, and the capped inner-sleeve transported to the laboratory.

The piston 18 is of sandwich construction, in which rubber seals are intercalled with metal washers. A bolt passes through the centre of the seals and washers. By tightening this bolt, the tightness of the fit of the piston in the sleeve can be adjusted.

In the sampler of the invention there is very little likelihood of the sample being shaken or dislodged out of the sample-containing inner-sleeve. The inner sleeve itself is flimsy enough to be easily cut away, and yet the sampler has little limitation as regards the vigour with which it can be hammered into the ground. The outer sleeve 14 is the component which transmits the hammer blows, and the outer sleeve 14 is easily able to do this because it is of steel, of 5 or 6 mm thickness.

The drive-shoe 12 is also of steel, and is hardened for a long service life.

In fact, the sampler is so strongly resistant to damage by hammering that if the hammer blows really are too vigorous the area to fail might tend to be not the sampler itself but the screw-thread connection 19 between the adapter 35 and the stalk 31. The presence of the long un-threaded length 40 between the thread 19 and the annular abutting faces 41 means that some elasticity is locked into the junction when the thread is tightened. This elasticity tends to hold the faces 41 firmly together during the hammer blows, which reduces the tendency of the faces to mushroom outwards. Thus, if any thread fails, it is not likely to be the (expensive-to-replace) left-hand thread 19.

The outer-sleeve 14 preferably is the same at both ends, so that the upper-drive-head 10 and the drive-shoe 12 may be screwed onto either end.

I claim:

1. Sediment sampler, which comprises:

an inner-sleeve (16), made of such material and to such dimensions that the inner-sleeve would collapse if subjected to substantial hammer blows directed axially along the length of the inner-sleeve;

an outer-sleeve (14), made of such material and to such dimensions that the outer-sleeve can withstand substantial hammer blows directed axially along the length of the outer-sleeve;

an upper-drive-head (10);

a drive-shoe (12);

an upper-attachment-means (27), by means of which the outer-sleeve may be attached to the upper-drive-head in such a manner as to transmit axially directed hammer blows from the upper-drive-head to the outer-sleeve;

a lower-attachment-means (29), by means of which the outer-sleeve may be attached to the drive-shoe in such a manner as to transmit axially directed hammer blows from the outer-sleeve to the drive-shoe;

where the outer-sleeve, the upper-drive-head, and the drive-shoe may be attached together and when so attached comprise a barrel-assembly (21);

an upper-shoulder (23), which is formed in the upper-drive-head;

a lower-shoulder (25), which is formed in the drive-shoe;

where the two shoulders face each other when the barrel-assembly is assembled, one towards each end of the barrel-assembly;

where the barrel-assembly is so dimensioned as to receive the inner-sleeve inside the barrel-assembly;

where, when the inner-sleeve is inside the barrel-assembly, the inner-sleeve is located with its axial ends between the two shoulders;

a piston (18) which is arranged to be a sealing, sliding fit along the length of the inner-sleeve;

a piston-holding-means (20) which is suitable for holding the piston against downwards movement with the barrel-assembly when the barrel-assembly is hammered down into the ground;

where the inner-sleeve may be removed from the barrel-assembly upon dis-assembly of the barrel-assembly;

and where the piston-holding-means is a cable (20), which is attached to the piston (18), and which passes out through a hole (39) formed through the upper-drive-head (10).

* * * * *